US008540109B1

(12) United States Patent
McPeek et al.

(10) Patent No.: US 8,540,109 B1
(45) Date of Patent: Sep. 24, 2013

(54) DEVICE STOWING MECHANISM

(75) Inventors: Mark V. McPeek, Cedar Rapids, IA (US); Roger D. Eller, Cedar Rapids, IA (US); Josh M. Roe, Cedar Rapids, IA (US); Stephen R. Blair, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 160 days.

(21) Appl. No.: 12/885,501

(22) Filed: Sep. 18, 2010

(51) Int. Cl.

| | |
|---|---|
| ***B65D 1/24*** | (2006.01) |
| ***B65D 25/04*** | (2006.01) |
| ***B65D 85/00*** | (2006.01) |
| ***B65D 90/54*** | (2006.01) |
| ***B65D 5/50*** | (2006.01) |
| ***H05K 5/00*** | (2006.01) |
| ***G12B 9/00*** | (2006.01) |
| ***A45C 13/02*** | (2006.01) |
| ***A47B 81/00*** | (2006.01) |

(52) U.S. Cl.
USPC ..... 220/578; 220/529; 220/536; 220/629; 220/212; 220/559; 220/720; 220/812; 206/817; 206/320; 206/751; 206/754; 206/759; 361/679.41; 248/917; 248/274.1; 248/284.1; 248/27.1; 248/200; 190/36; 312/223.2; 312/223.3; 312/273; 312/274; 312/275; 312/276

(58) Field of Classification Search
USPC ..... 220/529, 578, 629, 212, 212.5, 559, 220/720, 810, 536; 361/679.41; 248/917, 248/274.1, 284.1, 27.1, 27.3, 200; 190/36; 206/817, 320, 751, 754, 755, 758, 759; 312/223.2, 223.3, 273–277
See application file for complete search history.

(56) References Cited

U.S. PATENT DOCUMENTS

| | | | | |
|---|---|---|---|---|
| 5,209,335 | A * | 5/1993 | Shuren et al. | 194/200 |
| 5,781,232 | A * | 7/1998 | Ejima | 348/231.7 |
| 7,584,705 | B2 * | 9/2009 | Chen | 108/50.01 |
| 2005/0236536 | A1 * | 10/2005 | Fan | 248/176.3 |

* cited by examiner

*Primary Examiner* — Anthony Stashick
*Assistant Examiner* — Jennifer Castriotta
(74) *Attorney, Agent, or Firm* — Donna P. Suchy; Daniel M. Barbieri

(57) ABSTRACT

A stowing mechanism for a laptop or other device can secure different devices with varying thicknesses and widths within a compartment. The mechanism includes a cover which serves as the actuator for a jack mechanism. A pressure plate pivotally attached to the jack mechanism pushes against the device when the lid is closed, thereby securing the device within the compartment. The device can be released from the secure position by opening the cover. A buffer spring operating in conjunction with the jacking mechanism allows the mechanism to secure devices having different thicknesses and widths, while the pivotal pressure plate allows the plate to conform to devices having different shapes.

18 Claims, 8 Drawing Sheets

DEVICE STOWING MECHANISM

CROSS-REFERENCE TO RELATED APPLICATIONS

The present application is being filed concurrently with application Ser. No. 12/885,506, entitled "Sliding Lock Mechanism" and by the same inventors as the present application, which application is hereby incorporated by reference in its entirety to the present application.

BACKGROUND

Devices are known for docking laptop computers for connection to external monitors, power supplies, control devices and connection to networks. Such devices can be universal types or specific to a laptop model. In some instances, such as with a model specific device, the laptop may be directly connected with the device. In other instances, such as for a universal device, the laptop may be connected to the device only via connecting cables.

SUMMARY OF THE INVENTION

A device stowing mechanism of the present invention includes a compartment defined by at least a portion of a housing and a pressure plate positioned within the housing and operated by a jack mechanism to move the pressure plate between a securing position toward a laptop computer or other device positioned between the housing and the pressure plate and an unsecuring position away from the laptop. At least one buffering spring is used in conjunction with the jack mechanism to accommodate various laptop sizes and shapes within the compartment. A cover of the stowing mechanism can serve as the actuator of the jack mechanism and further define the compartment. Additionally a base and side walls can complete the enclosure of the compartment.

The cover has at least two positions, an open position and a closed position. In the open position, the laptop can be loaded into the compartment. The cover can then be pushed toward the closed or second position.

As the cover closes, the linkages drive a driving carriage downward on a slide rail. A sliding carriage is attached to the pressure plate via linkage arms to move the pressure plate toward and away from the laptop. The spring is disposed between the driving carriage and the sliding carriage and moves the sliding carriage via movement of the driving carriage. The spring acts as a buffer between movement of the driving carriage and movement of the sliding carriage and thus allows the stowing mechanism to accommodate laptops and other devices having varying thicknesses. The process is reversed by unlocking the cover via a latch and pulling upward on the cover.

The mechanism is totally contained within the compartment which can also contain an electric interface box having a variety of outlets to accommodate connection to various connectors of a variety of laptops. The compartment can be secured to the floor of a cockpit via mounting lugs on the base of the compartment. Furthermore, additional compartments can be stacked back to back by utilizing offset mounting lugs on the base.

DETAILED DESCRIPTION

Figure 1:
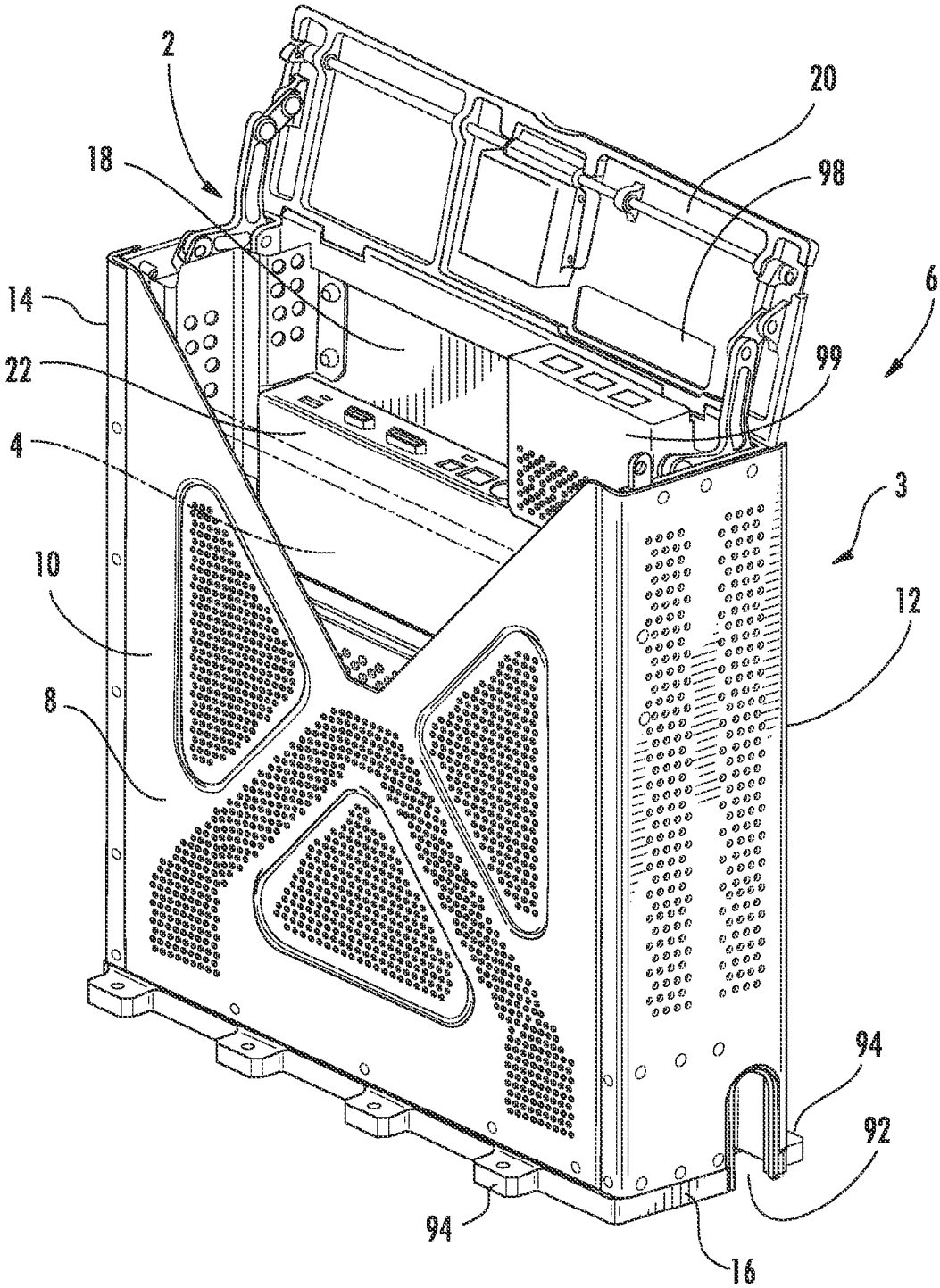
FIG. 1 is a perspective view of the present invention stowing mechanism showing a laptop computer or other device positioned within a compartment of the stowing mechanism.

Now referring to the drawings, FIG. 1 shows a stowing mechanism 2 for a laptop or other device 4 held within a compartment 6 in a vertical configuration. The compartment 6 can be a space defined by a portion of the housing 8, which can be a front wall 10; two side walls 12, 14; a base 16; a rear wall 18; and a cover 20. These components combine to form a box 3, which surrounds the laptop 4 and protects it from external impact or other damage. The housing can be perforated to allow for cooling air flow. In addition to the laptop 4, the box 3 can also house an interface device 22, which can include a power supply having the ability to power a variety of brands and types of laptops or other devices. Thus, the interface device can recharge batteries or provide external power to the device, whether the device is in use or not when stowed in the stowing mechanism. The interface device can also include other connectors for connecting to a laptop video output, for connecting the laptop 4 to a network, for connecting external control devices to the laptop 4 and for making any other desired connections with the laptop or other device 4. These connections can be made between the interface device 22 and the laptop or other device 4 via connector cables having appropriate connector ends. The box 3 can also house a control panel 99 for controlling the laptop 4, which control panel 99 is accessible through a window 98 in cover 20 when the cover 20 is in a closed position.

Figure 2:
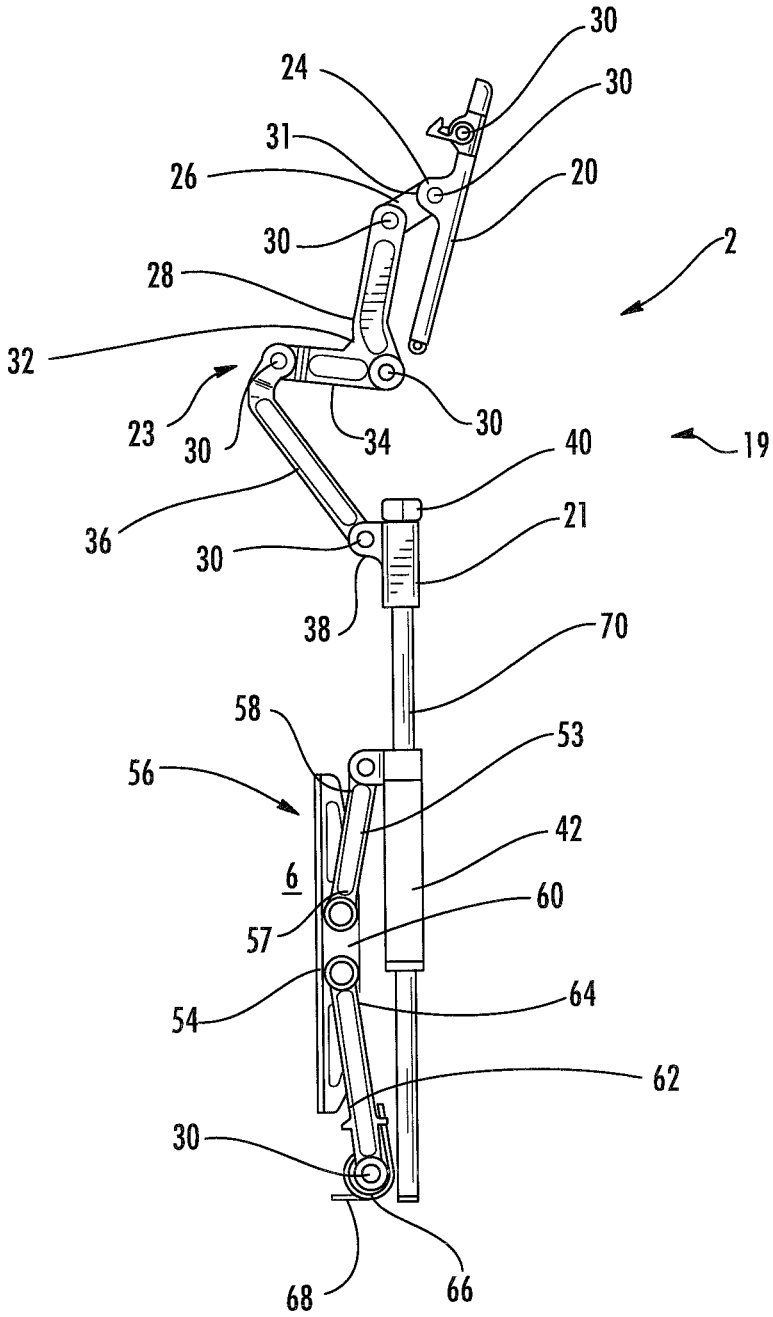
FIG. 2 is a cut away side view of the stowing mechanism in an open position.
Figure 3:
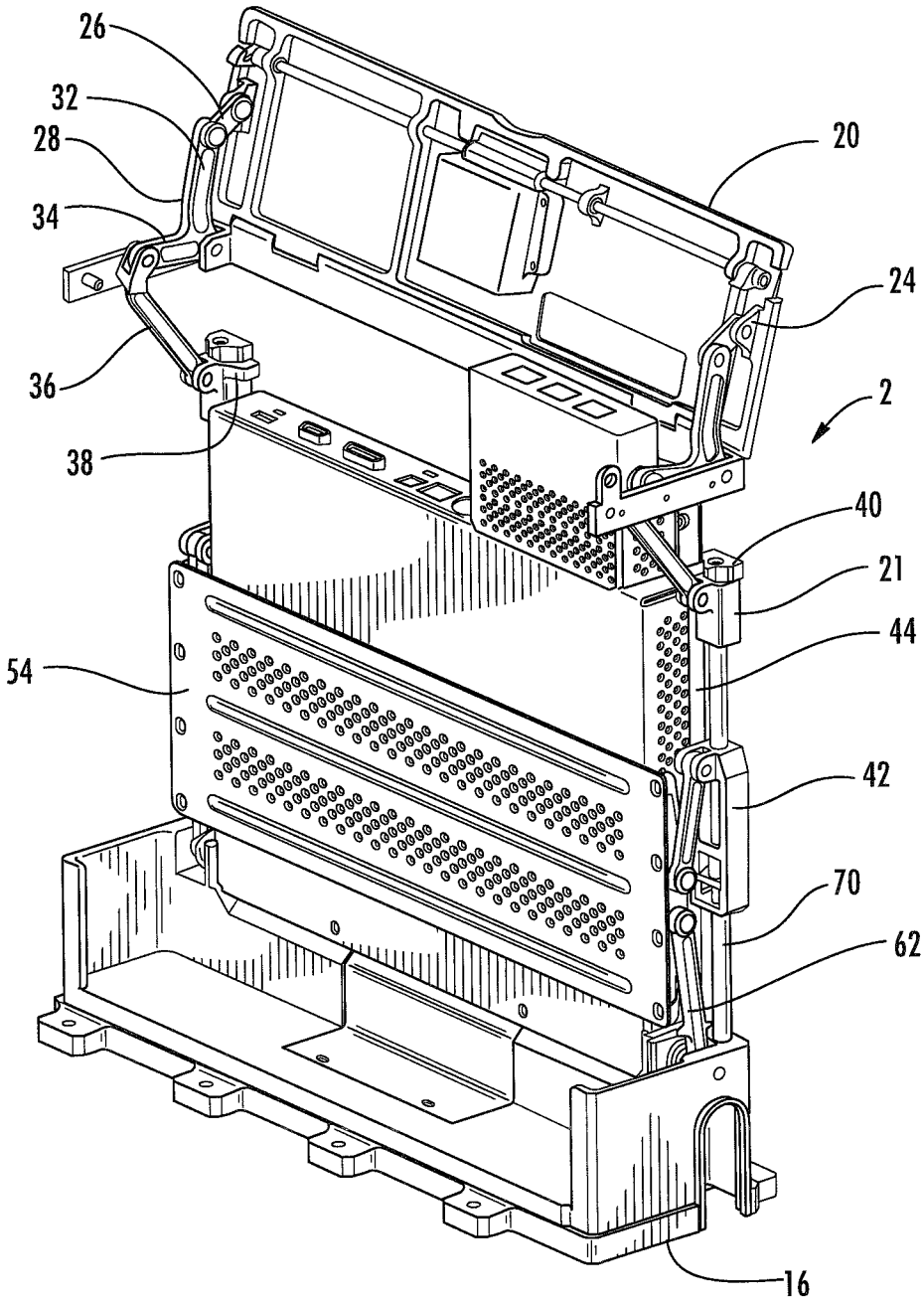
FIG. 3 is a cut away front perspective view of the stowing mechanism in an open position mounted on a base.
Figure 4:
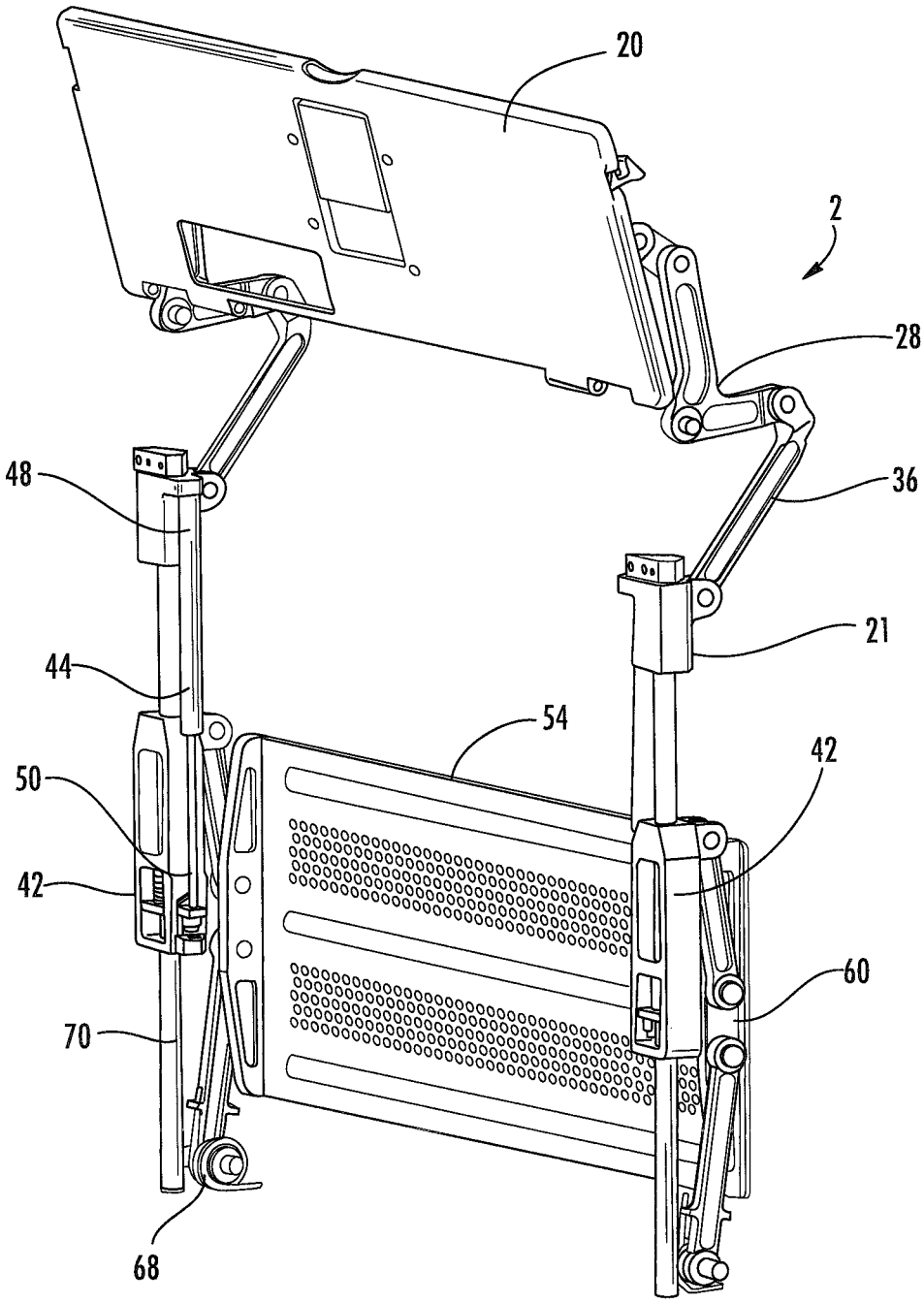
FIG. 4 is a cut away rear perspective view of the stowing mechanism in an open position.

FIGS. 2-4 show an embodiment of the stowing mechanism 2 in a first position corresponding to an open position. In this open position, the laptop or other device 4 can be loaded into the compartment 6. The cover 20 is in a near vertical position and is pivotally attached to one of the parts defining the space of the compartment 6, the rear wall 18 in this embodiment.

Through a system of operating linkages 19, including cover linkages 23, the cover 20 is in communication with a pair of driving carriages 21. One side of the mechanism will now be described, with the opposite side having the same detail. See, for instance, FIG. 4. It will be noted that the stowing mechanism can operate with a pair of opposed mechanisms as shown, with only a single mechanism, or with more than two mechanisms.

The cover 20 can have a depending ear 24 which is connected to an L-shaped pivot arm 28 via a first connecting member 26. The points of connection between the ear 24, first connecting member 26 and pivot arm 28 are all pivotable and each held together with pivot pins 30, which each engage a respectively positioned bore 31 in each of the cover linkages 23. The pivot arm 28 has a first extending link 32 and a second extending link 34 which are generally perpendicular to one another in the preferred embodiment, forming an L-shape. The first extending link 32 is longer than the second extending link 34 to increase leverage as the cover 20 is moved between the closed and open positions. The pivot arm 28 is pivotally attached via pivot pin 30 to one of the stationary structures, such as a side wall 12, 14 and/or the rear wall 18. A second connecting member 36 is pivotally attached at one end to the second extending link 34 via one of the pivot pins 30, and also pivotally attached at an opposite end to a flange 38 of the driving carriage 21. The second connecting member 36 is shaped to provide clearance space for a mounting bracket 40 while the mechanism 2 is in a closed position, and in this embodiment is somewhat L-shaped. See FIGS. 5-7 to see how the L-shaped second connecting member 36 clears the mounting bracket 40 when the stowing mechanism is in the closed position.

The driving carnage 21 is in further connection with a sliding carriage 42 via a drive spring 44 (see FIG. 4). In the preferred embodiment, the drive spring 44 is a gas spring having a first end 48 and second end 50, wherein the first end 48 is attached to an inner flange of the driving carriage 21 and the second end 50 is attached to an inner side of the sliding carriage 42. In this embodiment, first end 48 is the cylinder of the gas spring 44 and the second end 50 is the ram 52 of the gas spring 44, although this can be reversed. In the preferred embodiment, the gas spring 44 is vertically positioned, in alignment with a slide rail 70 on which the driving carriage 21 and sliding carriage 42 move. The use of a gas spring 44 also provides damping to the mechanism which improves performance of the mechanism under vibration.

The sliding carriage 42 is in turn connected to a pressure plate 54 via a first linkage arm 53 of a jack mechanism 56. The first linkage arm 53 has a first end 57 pivotally attached to the sliding carriage 42 and a second end 58 pivotally attached to a flange 60 which extends from and is attached to the pressure plate 54. The flange 60 can be a separate component attached to the pressure plate 54 or can be integral with the pressure plate 54. A second linkage arm 62 has a first end 64 and a second end 66. The first end 64 is also pivotally attached to the flange 60, below the location where the first linkage arm 53 attaches to the flange 60. This configuration allows the pressure plate 54 to pivot in two locations and better secure differently shaped laptops, and especially, laptops that have covers/bases slanted toward a front or rear side. The second linkage arm 62 is pivotally attached via second end 66 to a stationary structure such as the side wall 12, 14. A second spring 68 is positioned between the second linkage arm 62 and the stationary structure to bias the second linkage arm 62, and the pressure plate 54, toward an unsecured position in a direction away from the laptop or other device. Alternatively, the second spring 68 can also be operatively positioned between the second linkage arm 62 and the pressure plate 54, between the first linkage arm 53 and the pressure plate 54 or the sliding carriage 42, between the pressure plate 54 and the stationary structure, or elsewhere. A second spring 68 can also be positioned in multiple positions.

Figure 5:
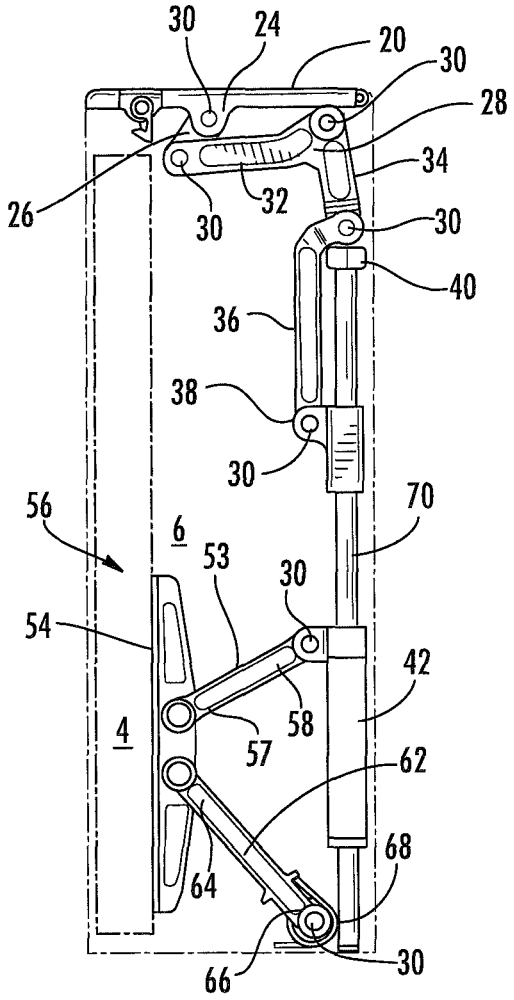
FIG. 5 is a cut away side view of the stowing mechanism in a closed position.
Figure 6:
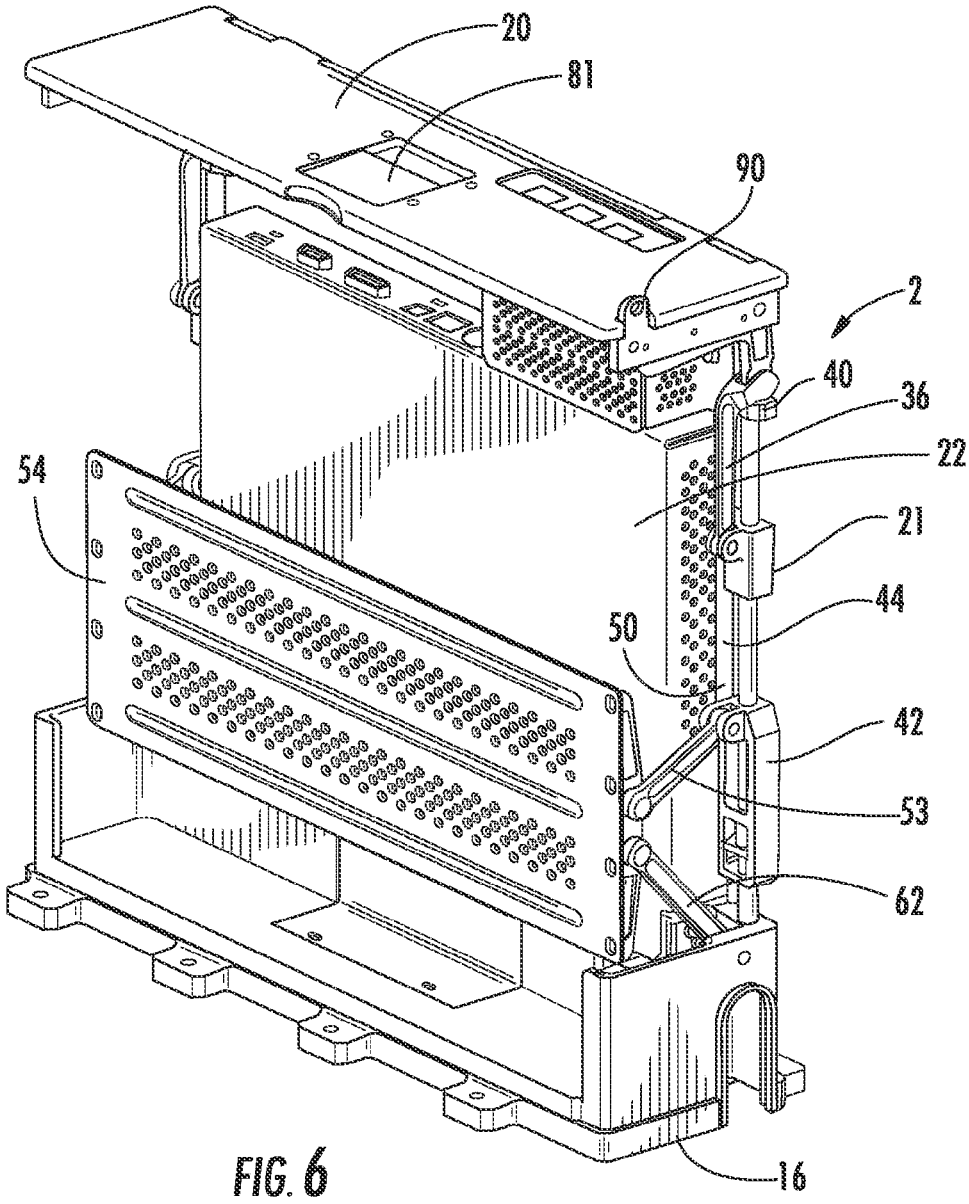
FIG. 6 is a cut away front perspective view of the stowing mechanism mounted on a base and in a closed position.
Figure 7:
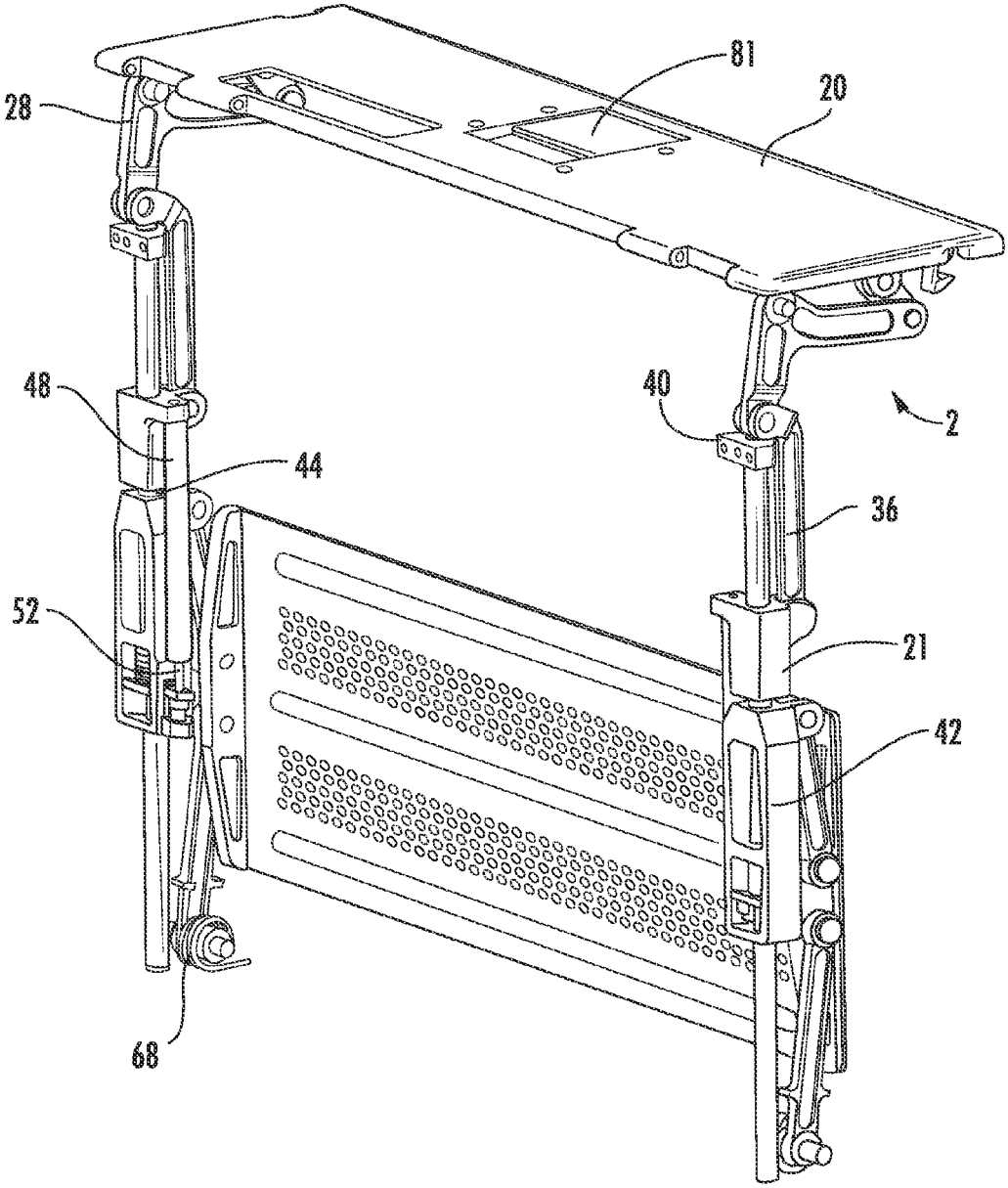
FIG. 7 is a cut away rear perspective view of the stowing mechanism in a closed position.

The sliding carriage 42 and the driving carriage 21 are selectively movable upon the slide rail 70. Preferably, the sliding carriage 42 and driving carriage 21 each contain a central bore on which they are held on the slide rail 70. Preferably, the slide rail 70 is anchored to the stationary structures at both ends of the slide rail 70 for stability. As mentioned above, the preferred embodiment uses an identical set of components (although such components can be mirror images of the components described above) on the opposite side of the compartment 6. FIGS. 5-7 show the components described above when the cover 20 is in the second or closed position. The cover 20 is pivotally mounted on an axis perpendicular to axes of the slide rails 70.

The mechanism of the invention can be best described by referring to FIGS. 3-4 and 6-7 which respectively show the parts in the first/open position and the second/closed position. It is to be understood that there are a number of intermediate positions between the first and second positions.

In the preferred embodiment, the cover 20 is used as the actuator for the jack mechanisms 56. As the cover 20 is pivotally moved toward the closed position, or downward toward the compartment 6, it moves the cover linkages 23, the driving carriages 21, the sliding carriages 42 and thus, the jack mechanisms 56 and pressure plate 54. More specifically, movement of the cover 20 from the open position to the closed position forces the pivot arm 28 to pivot around its pivot pin 30 such that the first extending link 32 is pushed toward a near horizontal position and the second extending link 34 is forced to a toward a near vertical position.

The movement of the second extending link 34 forces the driving carriage 21 downward on the slide rail 70 via the second connecting member 36. Since the gas spring 44 is attached between the driving carriage 21 and the sliding carriage 42, downward movement of the driving carriage 21 causes the gas spring 44 to move the sliding carriage 42 downward on the slide rail 70, overcoming the biasing force of the second spring 68. Placement of the gas spring 44 between the driving carriage 21 and the sliding carriage 42 maintains the gas spring 44 in alignment with the slide rail 70 at all times. This generally eliminates side loads on the gas spring 44, which side loads increase wear of internal sealing o-rings of the gas spring 44, Thus, the reliability and service life of the gas spring 44 are improved. The movement of the sliding carriage 42 moves the second end 58 of the first linkage arm 53 of the jack mechanisms 56, 72 toward the second end 66 of the second linkage arm 62 thereby pushing the first ends 57, 64, and thus the pressure plate 54, toward the laptop 4. In this manner, the pivotal movement of the cover 20 is converted to the transverse movement of the pressure plate 54. That is, in the preferred embodiment, the pressure plate 54 moves in a direction perpendicular to the axes of the slide rails. Other movement orientations can be used in alternative embodiments.

At some point between the open and closed positions of the cover (depending on the thickness of the laptop or device), the pressure plate 54 contacts the laptop 4. Then, the gas spring 44 acts as a buffer between movement of the cover 20/driving carriage 21 and movement of the sliding carriage 42/pressure plate 54 to limit the amount of clamping pressure that can be applied against the laptop to prevent damage to the laptop, and to accommodate a range of thicknesses of laptops that can be effectively clamped between the compartment wall and the pressure plate. The range of lateral movement of the pressure plate to effectively clamp the desired range of thicknesses of laptops thus determines the minimum needed amount of compression of the gas spring 44, after considering the geometry of the operating mechanism. With a thicker laptop 4, the pressure plate 54 will contact the laptop 4 when the cover 20 is still a first distance from being in the closed position. On the other hand, the thinner the laptop is with respect to the thicker laptop 4, the nearer the cover 20 will be to the closed position when the pressure plate 54 contacts the laptop 4. At the point of contact of the pressure plate 54 with the laptop 4, the cover 20 will still not be in the closed position, whether the laptop is thick or thin (within the desired range of thicknesses to be covered). Further movement of the cover 20 to the closed position will cause compression of the gas spring 44, with greater compression for a thicker laptop and lesser compression for a thinner laptop. The use of a gas spring 44 allows the amount of pressure exerted by the gas spring on the sliding carriage 42, and thus, the amount of pressure exerted by the pressure plate 54 on the laptop 4, to remain relatively constant whether the laptop 4 is thick or thin. The spring force for the drive springs is selected to provide a clamping force sufficient to secure the device without causing damage to the device. Once the cover 20 is in the fully closed position, the laptop 4 or other device is secured.

The use of a drive spring 44 on each of the pair (or other number) of operating mechanisms also allows for accommodation of irregularly shaped laptops by allowing for different amounts of movement of opposite ends of the pressure plate 54. Each of the drive springs 44 can compress a different amount, thereby allowing each jack mechanism, and thus, each side of the pressure plate 54, to move a different amount toward the laptop 4, independently of one another within a reasonable allowable plate deflection, to accommodate a laptop 4 that is thicker on one side than on the other side. In an alternative embodiment, the pressure plate 54 can be mounted to each of the flanges 60 on vertically pivotal joints, thereby allowing greater pivoting of the pressure plate 54 from side to side to accommodate greater side to side thickness variations of devices. In the embodiment shown, the pressure plate 54 is connected on opposite sides to the first and second jack mechanisms. In another alternative embodiment, each jack mechanism can have its own separate pressure plate. The pressure plate 54 is also pivotal top to bottom about first ends 57 and 64 of the first and second linkage arms 53 and 62 to conform to wedge shaped top to bottom profiles (as the device is situated in the compartment) of different devices.

In the embodiment shown, each drive spring 44 is positioned beside and parallel with its respective slide rail. By positioning the spring between a topward mounted lug on the driving carriage 21 and a bottomward mounted lug on the sliding carriage 42 (see FIG. 4), the allowable length of the drive spring 44 can be increased, along with the range of compression of the drive spring 44, thereby accommodating a greater range of thicknesses of laptops to be stowed.

In a preferred embodiment, the pressure plate 54 will have a relatively soft surface that engages the laptop 4 to prevent scratching or other damage to the laptop 4, as well as to provide a better clamping grip between the pressure plate 54 and the laptop 4. This surface can be an integral part of the pressure plate or a separate surface material attached to or applied over the pressure plate 54.

Another feature of the stowing mechanism 2 is the "over-center" operation of the cover 20/pivot arm 28. The location of the pivotable attachment of the second connecting member 36 and the pivot arm 28 is on one side of the drive spring 44 in the opened position and crosses over a center of compression of the drive spring 44 as the pivot arm 28 travels from the open position to the closed position, thereby resulting in a downward pulling force on the cover after the pivot arm crosses over the center of compression of the drive spring. This results in a positive tactile feel for the user indicating that the cover has completely closed, as well as helps maintain the cover 20 in the closed position.

To further maintain the cover 20 in the closed position, the cover 20 is also equipped with a positive latch mechanism 81 attached to the cover 20. In order to safeguard the contents of the compartment 6, a padlock ear 90 contains a bore which can receive a padlock or other locking instrument and thereby prevent opening of the cover 20 until the lock is removed.

In reversing the process and going from a closed position to an open position, the latch 81 is pulled upward releasing the cover 20 so that the cover 20 can be rotated to the open position, thereby reversing the operation described above.

The base 16 can include features which allow two or more boxes 3 to be stacked back to back to one another. First power cords and other cords necessary to run the laptop can enter the compartment 6 through a cavity 92, thus allowing the cords to enter the bottom of wall 12. Additionally, the lugs 94 on the front of the base 16 are offset from the lugs 94 on the rear of the base 94 to allow a nesting relationship between the lugs of a front side of one stowing mechanism with the lugs of a rear side of a second stowing mechanism.

Other embodiments are possible, including one in which the second end of the gas spring is attached directly to the pressure plate 54. Such an embodiment would omit the sliding carriage and the parts associated with the sliding carriage. Another embodiment is one in which the first end of the gas spring 48 is attached directly to the L-shaped pivot arm 28. Such an embodiment would omit the drive carriage and the parts associated with the drive carriage. Additionally, there are possible embodiments which remove, combine and/or reshape some of the linkages. Still other embodiments may remove certain parts such as the second spring and/or the latch mechanism. Another embodiment utilizes a compression coil spring between the driving carriage and sliding carriage instead of the gas spring. In such an embodiment, the compression spring can be positioned around the slide rail, as compared to the sideward positioning of the gas spring described above. Other types of springs can also be used throughout.

Figure 8:
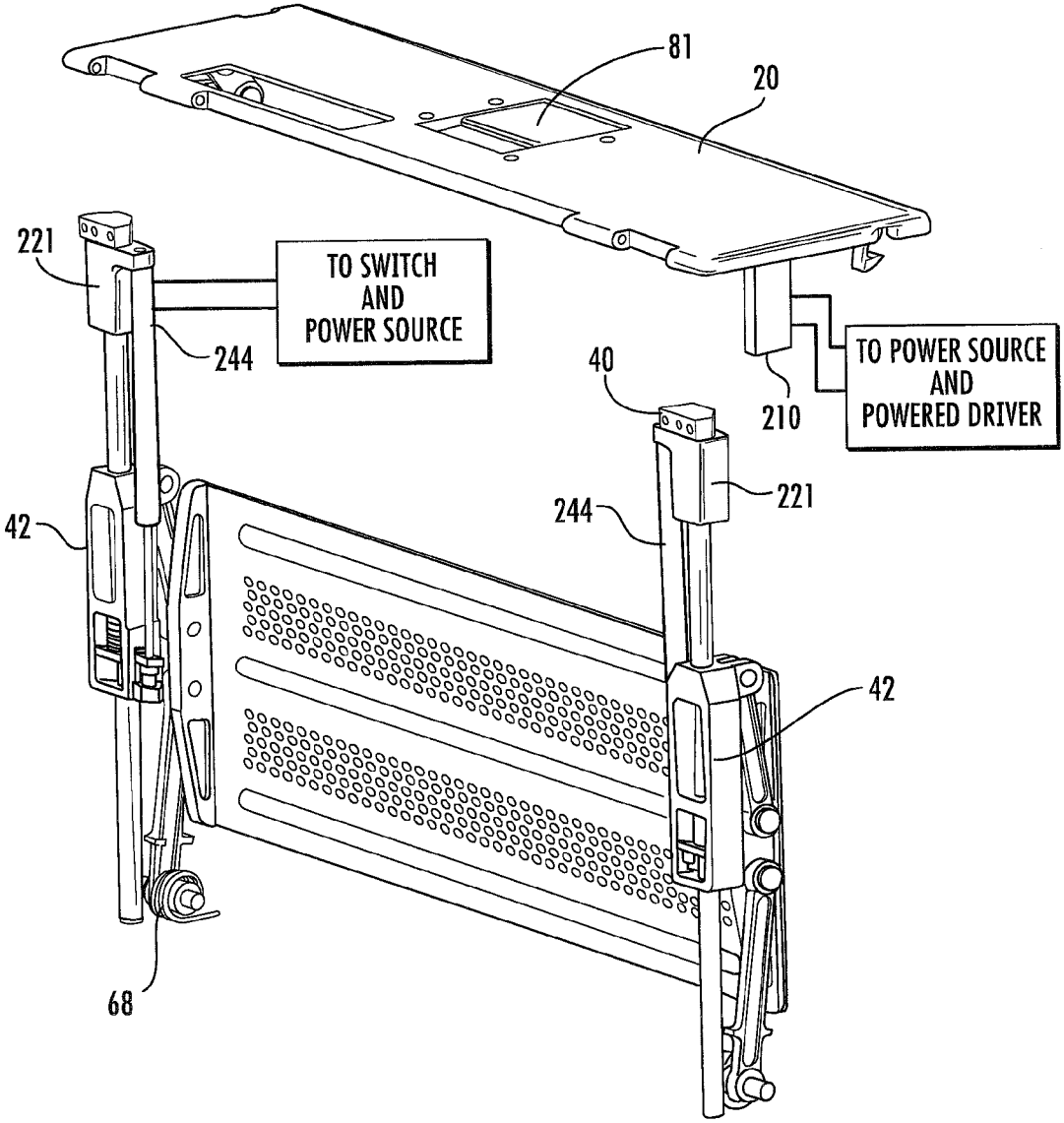
FIG. 8 is a cut away rear perspective view of an alternative embodiment of the stowing mechanism in a closed position.

In an alternative embodiment, the stowing mechanism 2 can use one or more powered drive mechanisms for actuating the jack mechanisms. The powered drive mechanism can include a powered screw mechanism, a linear drive motor, a hydraulic/air cylinder, or another type of powered drive mechanism. See FIG. 8. A powered drive mechanism 244 is attached between powered drive mount 221 and sliding carriage 42 of each jack mechanism for moving the respective sliding carriage 42 between the clamped and unclamped positions. A spring mechanism can be positioned between each powered drive mechanism 244 and either the powered drive mount 221 and the sliding carriage 42 to act as a buffer spring, as described above. A switch 210 is positioned to be actuated by the opening and closing of the cover 20 and is operatively connected to the powered drive mechanisms 244 for connecting to and disconnecting from a power supply, thereby powering on and powering off the powered drive mechanisms 244. Operation of the powered drive mechanisms 244 can also be at least partially controlled by a controller.

Also, operation of the switch or actuator can be separated from operation of the cover. Although the stowing device is shown vertically receiving the laptop, other orientations can also be used. The stowing device can be used in other environments, including helicopters, boats, trains, wheeled vehicles, military vehicles, construction vehicles, other types of vehicles, or even in stationary locations.

The use of the stowing mechanism of the present invention provides for quick and easy stowing of a laptop or other device brought into the environment. The stowing mechanism secures the device against movement and protects the device from external impact or other damage. When desired, the laptop can be quickly and easily unsecured and removed from the stowing mechanism, with the stowing mechanism then ready to receive another laptop. The described stowing mechanism provides for the secure holding of a wide range of sizes, shapes and types of laptops or other devices without modification to the stowing mechanism or procedure for using the stowing mechanism.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A stowing mechanism for a device comprising:

a housing;

an actuator;

a first jack mechanism;

a compartment formed between a portion of the housing and the jack mechanism for receiving the device;

a pressure plate attached to the first jack mechanism for securing the device;

wherein the actuator is selectively movable to actuate the first jack mechanism and thereby move the pressure plate between a secured position securing the device and an unsecured position allowing the device to be inserted into and removed from the compartment;

the pressure plate engaging the device and exerting a securing pressure on the device at the secured position;

a drive spring attached between the actuator and the pressure plate to act as a buffer between movement of the actuator and movement of the pressure plate to accommodate devices of varying widths.

2. The stowing mechanism of claim 1, and further comprising:

a sliding carriage;

wherein the first jack mechanism comprises a first linkage arm and a second linkage arm;

wherein the first linkage arm and second linkage arm each has a first end and a second end;

wherein the first end of each linkage arm is pivotally attached at separated points to the pressure plate to allow pivoting of the pressure plate with respect to the first and second linkage arms to better engage an irregularly shaped device;

wherein the second end of the second linkage arm is pivotally attached to a stationary structure;

wherein the second end of the first linkage arm is pivotally attached to the sliding carriage;

wherein the drive spring is attached between the sliding carriage and the actuator such that further movement of the actuator of the actuator after the pressure plate is in engagement with the device causes compression of the drive spring between the actuator and the sliding carriage.

3. The stowing mechanism of claim 2, wherein:

the compartment has a cover pivotally attached to the housing;

the cover serves as at least a portion of the actuator for the first jack mechanism;

closing and opening of the cover actuates the first jack mechanism thereby selectively moving the pressure plate between the secured position and the unsecured position.

4. The stowing mechanism of claim 3, and further comprising:

a driving carriage;

a slide rail, with the sliding carriage and the driving carriage both slideably mounted on the slide rail;

an operating linkage attaching the cover to the driving carriage such that pivotal movement of the cover causes movement of the driving carriage along the slide rail;

wherein the drive spring is connected between the driving carriage and the sliding carriage such that movement of the driving carriage along the slide rail causes movement of the sliding carriage along the slide rail.

5. The stowing mechanism of claim 4, wherein:

the operating linkage includes:

a pivot arm pivotally attached to the housing at a central portion and having a first extending link and a second extending link each extending away from the central portion at an angle with respect to one another;

a first connecting member pivotally attached between the cover and the first extending link at a point spaced away from the central portion of the pivot arm;

a second connecting member pivotally attached between the driving carriage and the second extending link at a point spaced away from the central portion of the pivot arm; the second connecting member being generally L-shaped so that as the pivot arm is moved by the cover toward the closed position, the pivotal attachment between the second connecting member and the pivot arm crosses over a center of compression of the drive spring such that once over center, the drive spring exerts a closing pressure on the cover.

6. The stowing mechanism of claim 5, and further comprising:

a second jack mechanism operated by the cover;

a second drive spring positioned between the second jack mechanism and the cover;

wherein the pressure plate has a first end and a second end;

the first jack mechanism is attached to the first end of the pressure plate;

the second jack mechanism is attached to the second end of the pressure plate;

the respective drive springs allow different movements of the first and second jack mechanisms to allow pivoting of the pressure plate between the first and second ends of the pressure plate to accommodate irregularly shaped devices.

7. The stowing mechanism of claim 6, wherein:

the drive spring is a gas spring which dampens vibrations in the operating system, the pressure plate is disengaged from the device in the unsecured position.

8. The stowing mechanism of claim 7, and further comprising:

a second spring positioned between the second linkage arm and the stationary structure to bias the pressure plate toward the unsecured position.

9. The stowing mechanism of claim 1, wherein the actuator is a powered drive mechanism comprising at least one of a powered screw mechanism, a linear drive motor and a hydraulic/air cylinder;

and further comprising a switch operatively connected to the powered drive mechanism for powering on and powering off the powered drive mechanism.

10. A stowing mechanism for a device, comprising:

an actuator;

a first jack mechanism;

a compartment formed between the jack mechanism and another structure for receiving the device;

a pressure plate attached to the first jack mechanism for securing the device;

wherein the actuator is selectively movable to actuate the first jack mechanism and thereby move the pressure plate between a secured position securing the device and an unsecured position allowing the device to be inserted into and removed from the compartment;

the pressure plate engaging the device and exerting a securing pressure on the device at the secured position;

a drive spring attached between the actuator and the pressure plate to act as a buffer between movement of the actuator and movement of the pressure plate to accommodate devices of varying widths.

11. The stowing mechanism of claim 10, and further comprising:

a sliding carriage;

wherein the first jack mechanism comprises a first linkage arm and a second linkage arm;

wherein the first linkage arm and second linkage arm each has a first end and a second end;

wherein the first end of each linkage arm is pivotally attached at separated points to the pressure plate to allow pivoting of the pressure plate with respect to the first and second linkage arms to better engage an irregularly shaped device;

wherein the second end of the second linkage arm is pivotally attached to a stationary structure;

wherein the second end of the first linkage arm is pivotally attached to the sliding carriage;

wherein the drive spring is attached between the sliding carriage and the actuator such that further movement of the actuator of the actuator after the pressure plate is in engagement with the device causes compression of the drive spring between the actuator and the sliding carriage.

12. The stowing mechanism of claim 11, and further comprising:

a driving carriage;

a slide rail, with the sliding carriage and the driving carriage both slideably mounted on the slide rail;

an operating linkage attaching the actuator to the driving carriage such that pivotal movement of the actuator causes movement of the driving carriage along the slide rail;

wherein the drive spring is connected between the driving carriage and the sliding carriage such that movement of the driving carriage along the slide rail causes movement of the sliding carriage along the slide rail.

13. The stowing mechanism of claim 12, wherein:

the operating linkage includes:

a pivot arm pivotally attached to the housing at a central portion and having a first extending link and a second extending link each extending away from the central portion at an angle with respect to one another;

a first connecting member pivotally attached between the actuator and the first extending link at a point spaced away from the central portion of the pivot arm;

a second connecting member pivotally attached between the driving carriage and the second extending link at a point spaced away from the central portion of the pivot arm; the second connecting member being generally L-shaped so that as the pivot arm is moved by the actuator toward the closed position, the pivotal attachment between the second connecting member and the pivot arm crosses over a center of compression of the drive spring such that once over center, the drive spring exerts a closing pressure on the actuator.

14. The stowing mechanism of claim 13, and further comprising:

a second jack mechanism operated by the actuator;

a second drive spring positioned between the second jack mechanism and the cover;

wherein the pressure plate has a first end and a second end;

the first jack mechanism is attached to the first end of the pressure plate, the second jack mechanism is attached to the second end of the pressure plate;

the respective drive springs allow different movements of the first and second jack mechanisms to allow pivoting of the pressure plate between the first and second ends of the pressure plate to accommodate irregularly shaped devices.

15. The stowing mechanism of claim 14, and further comprising:

a cover pivotally attached to the slide rail;

the cover serves as at least a portion of the actuator for the first jack mechanism;

closing and opening of the cover actuates the first jack mechanism thereby selectively moving the pressure plate between the secured position and the unsecured position.

16. The stowing mechanism of claim 15, wherein:

the drive spring is a gas spring which dampens vibrations in the operating system, the pressure plate is disengaged from the device in the unsecured position.

17. The stowing mechanism of claim 16, and further comprising:

a second spring positioned between the second linkage arm and the stationary structure to bias the pressure plate toward the unsecured position.

18. A stowing mechanism for a device comprising:

a housing;

an actuator;

a first jack mechanism;

a second jack mechanism;

a compartment formed between a portion of the housing and the jack mechanism for receiving the device;

a pressure plate attached at opposite ends to the first and second jack mechanisms for securing the device;

wherein the actuator is selectively movable to actuate the first and second jack mechanisms and thereby move the pressure plate between a secured position securing the device and an unsecured position allowing the device to be inserted into and removed from the compartment;

the pressure plate engaging the device and exerting a securing pressure on the device at the secured position, the pressure plate being disengaged from the device in the unsecured position;

first and second drive springs attached between the actuator and the first and second jack mechanisms, respectively, to act as buffers between movement of the actuator and movement of the pressure plate to accommodate devices of varying widths;

first and second sliding carriages;

wherein each jack mechanism comprises a first linkage arm and a second linkage arm;

wherein each of the first linkage arms and the second linkage arms has a first end and a second end;

wherein the first end of each linkage arm of the first jack mechanism is pivotally attached at separated points to the pressure plate and the first end of each linkage arm of the second jack mechanism is also pivotally attached at separated points to the pressure plate corresponding to the separated points of the first jack mechanism to allow pivoting of the pressure plate with respect to the first and second linkage arms to better engage an irregularly shaped device;

wherein the second ends of the second linkage arms are pivotally attached to a stationary structure;

wherein the second ends of the first linkage arms are pivotally attached to the sliding carriage;

wherein each drive spring is a gas spring and is attached between the respective sliding carriage and the actuator such that further movement of the actuator of the actuator after the pressure plate is in engagement with the device causes compression of the drive springs between the actuator and the sliding carriages;

first and second driving carriages;

first and second slide rails, with the first and second sliding carriages and the first and second driving carriages respectively slideably mounted on the first and second slide rails;

first and second operating linkages attaching the actuator to the first and second driving carriages respectively such that pivotal movement of the actuator causes movement of the driving carriages along the slide rails;

wherein each drive spring is connected between the respective driving carriage and the sliding carriage such that movement of the driving carriage along the slide rail causes movement of the sliding carriage along the slide rail;

wherein each operating linkage includes:

a pivot arm pivotally attached to the housing at a central portion and having a first extending link and a second extending link each extending away from the central portion at an angle with respect to one another;

a first connecting member pivotally attached between the actuator and the first extending link at a point spaced away from the central portion of the pivot arm;

a second connecting member pivotally attached between the respective driving carriage and the second extending link at a point spaced away from the central portion of the pivot arm; the second connecting member being generally L-shaped so that as the pivot arm is moved by the actuator toward the closed position, the pivotal attachment between the second connecting member and the pivot arm crosses over a center of compression of the drive spring such that once over center, the respective drive spring exerts a closing pressure on the actuator;

wherein the respective drive springs allow different movements of the first and second jack mechanisms to allow pivoting of the pressure plate between the opposite ends of the pressure plate to accommodate irregularly shaped devices;

a second spring positioned between the second linkage arm and the stationary structure to bias the pressure plate toward the unsecured position;

a cover pivotally attached to the housing;

wherein the cover serves as at least a portion of the actuator for the first and second jack mechanisms;

wherein pivotally closing and opening of the cover actuates the first and second jack mechanisms, thereby selectively moving the pressure plate transversely with respect to the compartment between the secured position and the unsecured position.

* * * * *